US008517361B2

(12) United States Patent
Sambuceto et al.

(10) Patent No.: US 8,517,361 B2
(45) Date of Patent: Aug. 27, 2013

(54) DRAWER FRONT JIG

(76) Inventors: Gary Sambuceto, Coupeville, WA (US); Linda Sambuceto, legal representative, Coupeville, WA (US); Eric Pello, Hamilton, WA (US)

( * ) Notice: Subject to any disclaimer, the term of this patent is extended or adjusted under 35 U.S.C. 154(b) by 361 days.

(21) Appl. No.: 12/932,519

(22) Filed: Feb. 28, 2011

(65) Prior Publication Data

US 2012/0217689 A1 Aug. 30, 2012

(51) Int. Cl.
*B25B 11/02* (2006.01)

(52) U.S. Cl.
USPC ..... 269/37; 269/43

(58) Field of Classification Search
USPC ..... 269/37, 55, 228, 45, 249, 246
See application file for complete search history.

(56) References Cited

U.S. PATENT DOCUMENTS

| | | | | |
|---|---|---|---|---|
| 5,401,354 | A * | 3/1995 | Colucci | 156/580 |
| 5,494,553 | A * | 2/1996 | Colucci | 156/580 |
| 5,785,305 | A * | 7/1998 | Stalker | 269/37 |
| 8,262,071 | B2 * | 9/2012 | Huang | 269/289 MR |
| 8,393,605 | B2 * | 3/2013 | Yang et al. | 269/287 |
| 2012/0217689 | A1 * | 8/2012 | Sambuceto et al. | 269/37 |

* cited by examiner

*Primary Examiner* — Lee D Wilson

(57) ABSTRACT

A drawer front jig with a base plate, a drawer front stop bar, a drawer box positioning bracket assembly, a rail and a first and second drawer box stop bar assembly. The drawer box stop bars each include an adjustment slot. The rail is attached to the top of the base plate. The drawer box stop bars are is held at right angles to the rail. The rail has longitudinal T shaped slots along its top and side surfaces. The bar and bracket assemblies are held onto the rail by lock lever mechanisms. The drawer front stop bar is held in place to the inner facing wall of the rail. When a person places a drawer front against the rail and places the drawer box on the drawer front, the jig helps the drawer front and drawer box to be accurately positioned so that they can be joined together in a standard way.

2 Claims, 4 Drawing Sheets

DRAWER FRONT JIG

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of carpenters tools and more specifically to drawer front jig.

It is common for carpenters perform various assembly tasks when working on a project such as the installation of kitchen cabinets. One type of assembly project that is commonly carried out by carpenters is the placement of drawer fronts onto corrosponding drawer boxes so that each front can be screwed or glued to each box. The resulting drawer is then slid into a waiting assembly that is typically built under a standard kitchen counter top. If the drawer front is not accurately attached to the drawer box, the drawer front may not be properly aligned with the other drawer fronts located above or below it. It is therefore necessary to be very accurate in the placement of each drawer front when attached to its mating drawer box.

To this end, it would be helpful to have a jig that can be adjusted to hold the drawer front and the box in the proper orientation with respect to each other so that the time needed to measure and locate each drawer front and drawer box is diminished. Other inventors have developed jigs that help with other aspects of the drawer making process. For example, U.S. Pat. No. 6,390,576 discloses a fixture that helps align the face of a drawer, the cabinet, and the drawer slide.

U.S. Pat. No. 5,507,607 describes a tool that helps place screws in the proper location to mount drawer hardware. U.S. Pat. No. 5,807,036 shows an adjustable drill jig for locating and drilling holes, but does not address the issue of locating and centering drawer fronts. However, none of the inventions described in the prior art teach the construction of a jig that can repeatedly and accurately align a drawer front with a drawer box so that they can be joined together quickly.

BRIEF SUMMARY OF THE INVENTION

The primary object of the invention is to provide a jig that quickly and accurately helps a person to locate and align a drawer front panel to a drawer box thereby increasing speed and accuracy of joining the two parts together during the process of cabinet making.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed drawer front jig comprising: a base plate, a rigid drawer front stop bar, a rigid drawer box stop bracket, a drawer box bracket retaining assembly, a bar and bracket assembly retaining rail member, a rigid first drawer box stop bar, a rigid second drawer box stop bar, a first stop bar retaining assembly, a second stop bar retaining assembly, each said drawer box stop bar including a length adjustment slot, said rail fixedly attached along the front edge of the top of said base plate, said drawer box stop bar held at right angles to said retaining rail by a standard bolt, said rail having a longitudinally disposed T shaped slot along its top surface, said rail having a longitudinally disposed T shaped slot along its inner side wall, each said bar and bracket retaining assembly held onto said rail by a standard lock lever mechanism that interacts with said T slots, each said bar and bracket retaining assembly comprised of a horizontal flat plate and a downwardly disposed fixedly attached plate formed at right angles to said flat plate, said downwardly disposed plates located to slidably engage the leading side wall of said rail member, said drawer front stop bar held in place to the inner side wall of said rail member by a standard bolt, and said drawer front stop bracket and said drawer front stop bars positioned high enough to allow a standard drawer front panel to reside under them.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
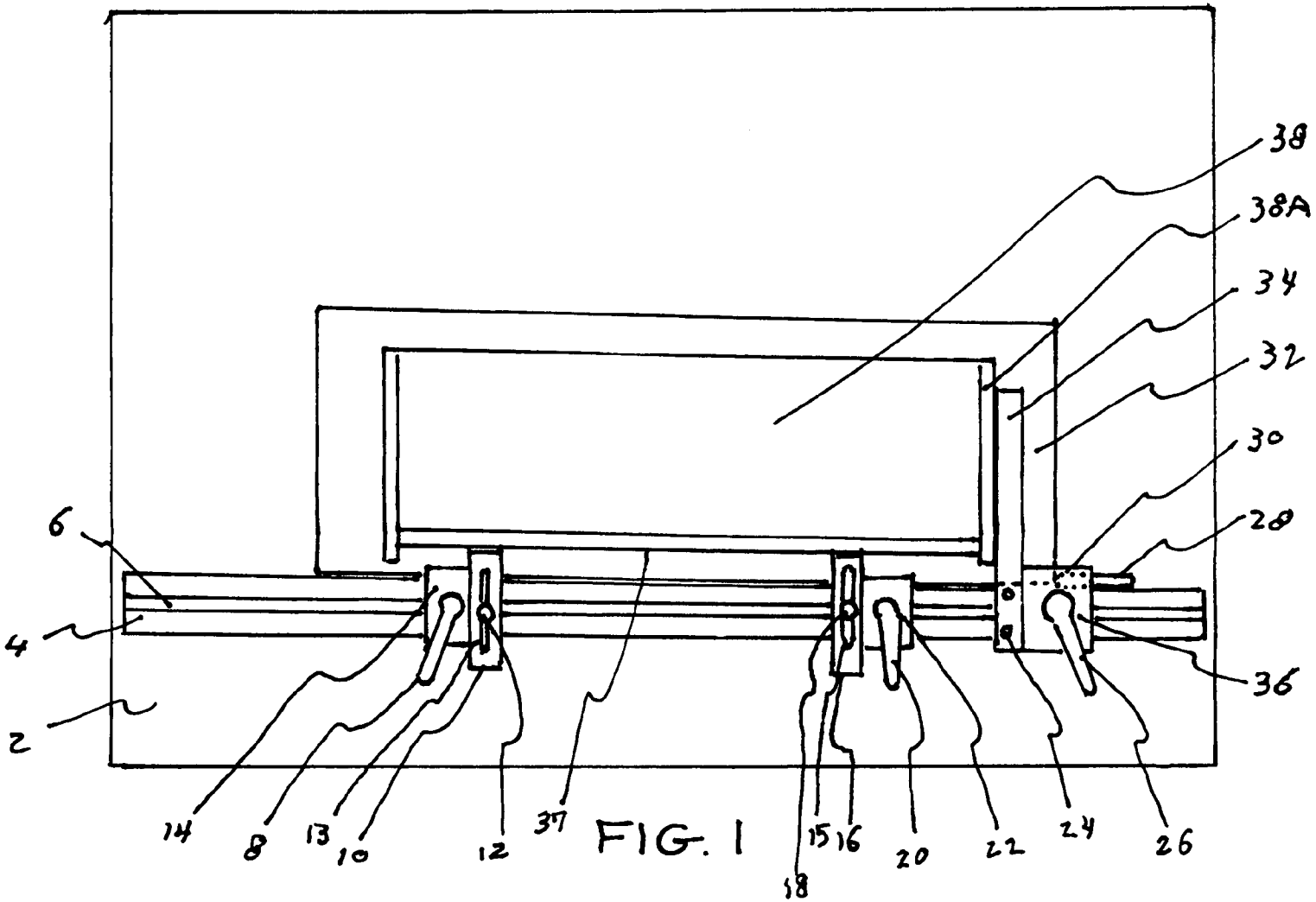
FIG. 1 is a plan view of the invention.

Referring now to FIG. 1 we see a plan view of the invention in use holding a drawer front 32 and a drawer box 30 in the proper orientation with respect to each other so that a person can fasten the two together in the process of making a typical drawer set for use under a standard kitchen counter. The drawer front 32 sits on a base plate 2. A rigid rail 4 is fixedly attached to the rigid base plate 2. The rail 2 has a T 6 slot built into the top surface and another T slot 40 built into the inner side surface. a rigid drawer front stop bar 28 is attached to the inner side surface and acts as a stop for the side of the drawer front 32 as shown by dotted lines 30. The side 38A of the box portion of the drawer 38 abuts a rigid box stop bracket 34. The bracket 34 is held in place by bracket retaining assembly 36. The assembly 36 engages with T slot 6 and is fixed in place when the user tightens lever arm 26 in a clockwise direction. Bolts 24 attach the bracket 34 to the horizontal plate of the bracket retaining assembly 36. The user can then adjust the length of first drawer box stop bar 10 and second drawer box stop bar 16 by loosening bolts 12, 18 and sliding the bars in or out via slots 13, 15 and then tightening the bolts 12, 18 when the front of the bars 10. 16 touch the under surface of the drawer bottom 37. The drawer box stop bars 10, 16 can be slid along track 6 to the desired location and then fixed into place by attached drawer box retaining assemblies 14, 22, that work in a similar way to bracket retaining assembly 36, where locking levers 8, 20 are used to fix the assemblies 14, 22 in the desired location. Once the jig of the present invention is set to receive both the drawer front 32 and the drawer box 38, the user can repeat the drawer front to drawer box alignment process as many times as necessary depending on how many drawers are needed for a particular kitchen installation. Obviously, the present invention can be used to align drawer fronts and drawer boxes of other typical installations that involve drawers, such as custom file cabinets, custom media centers or custom clothes retaining drawer assemblies.

Figure 2:
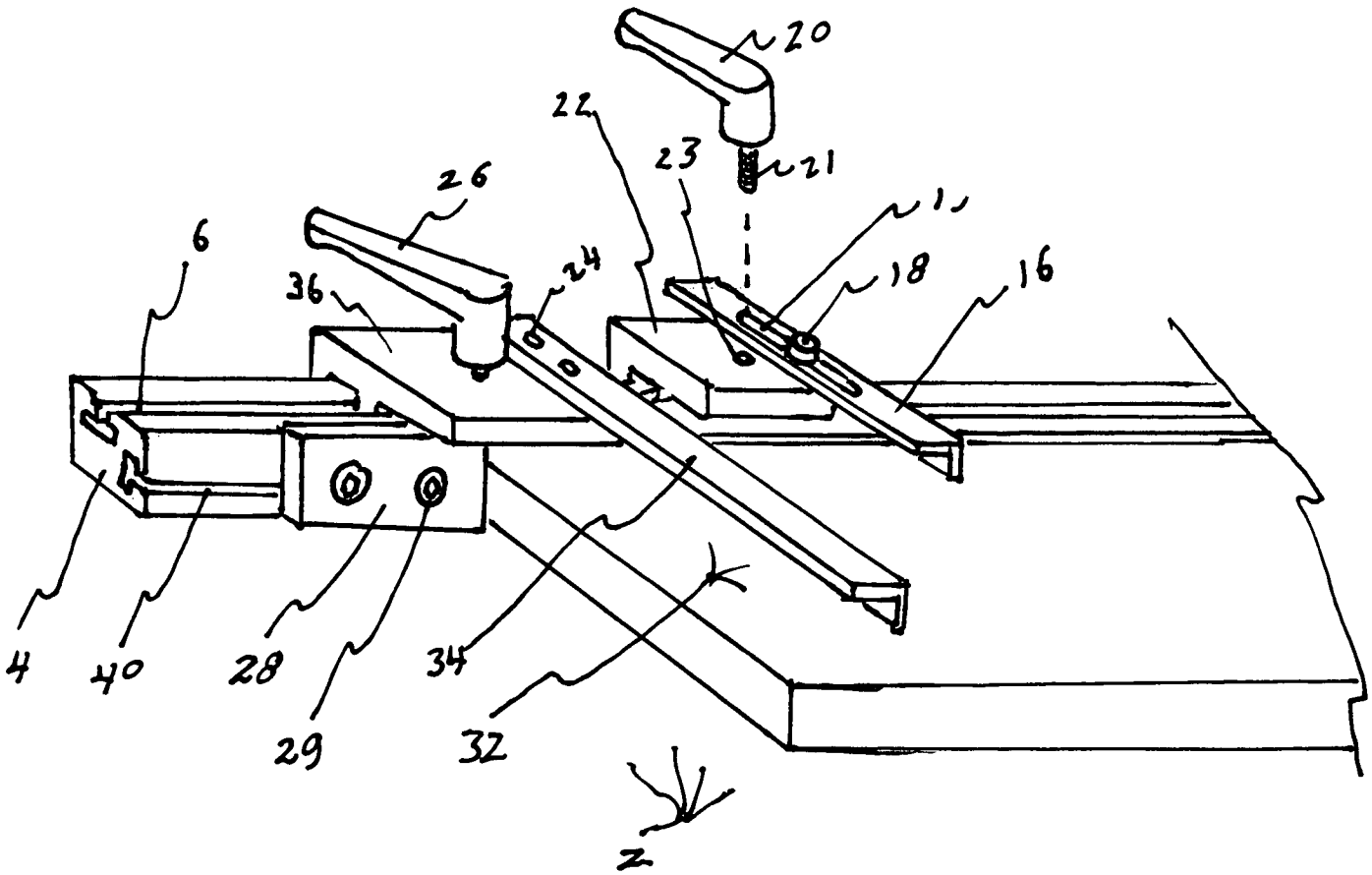
FIG. 2 is a partial perspective view of the invention.

Referring now to FIG. 2 we see partial perspective view of the invention where we can clearly see that drawer bottom 32, sitting on base plate 2 is pushed up against drawer front stop bar 28, which is held in place by bolts 29. The bolts 29 are retained into T slot 40 in a standard way. Drawer box stop bracket 34 is raised so that drawer bottom 32 can slide under it. The first drawer stop bar 16 can be clearly seen and locking lever 20 including attached bolt 21 is ready to be inserted into aperture 23 to lock the stop bar retaining assembly 22 in place. Drawer box stopping bar 16 and 18 are also raised so that drawer front 32, as well as drawer box panel 38B, as shown in FIG. 4, can easily pass under them.

Figure 3:
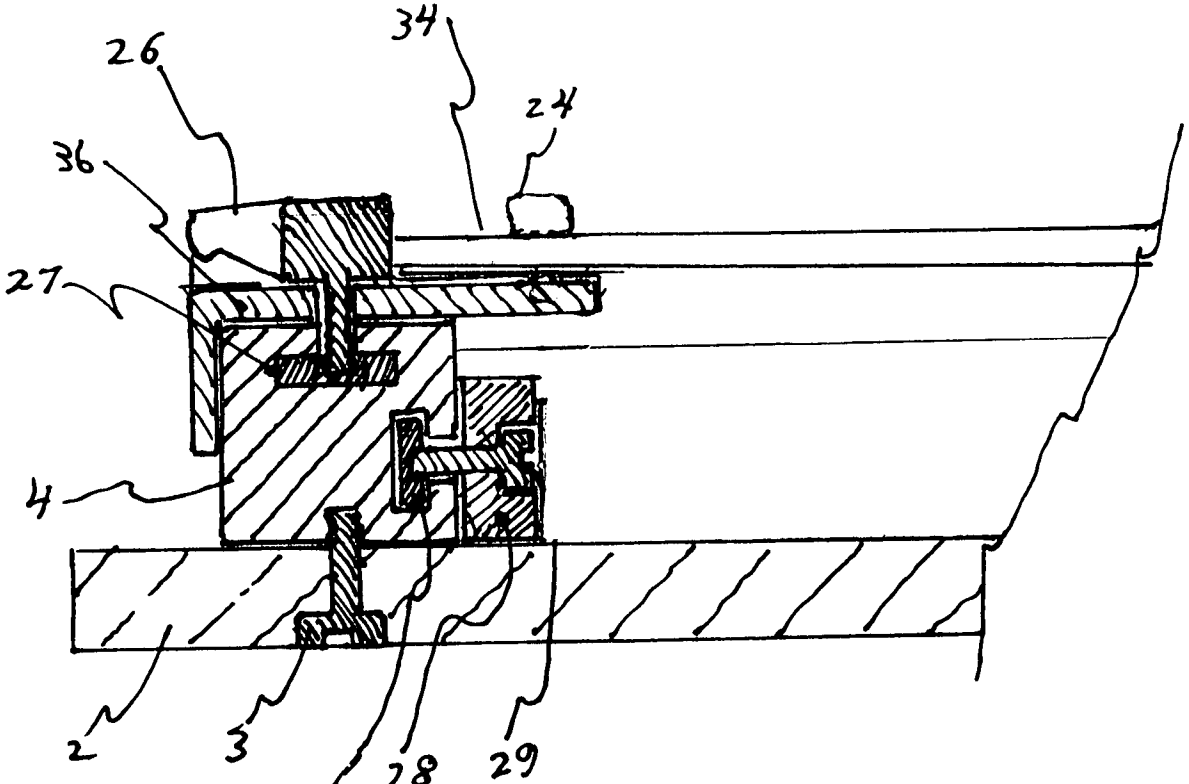
FIG. 3 is a partial section view of the invention.

FIG. 3 shows a partial side section view of the invention where drawer front stop bar 28, locking lever assembly 26 are bisected. A threaded plate 27 engages a threaded post the lever assembly so that when the lever 26 is turned clockwise, the plate 36 and attached bracket 34 are fixed in place. Likewise, threaded plate 32 retains the threads on locking bolt 29 to fix the drawer front stop bar 28 in place. Rail 4 is fixed to the base plate 2 via bolt 3.

Figure 4:
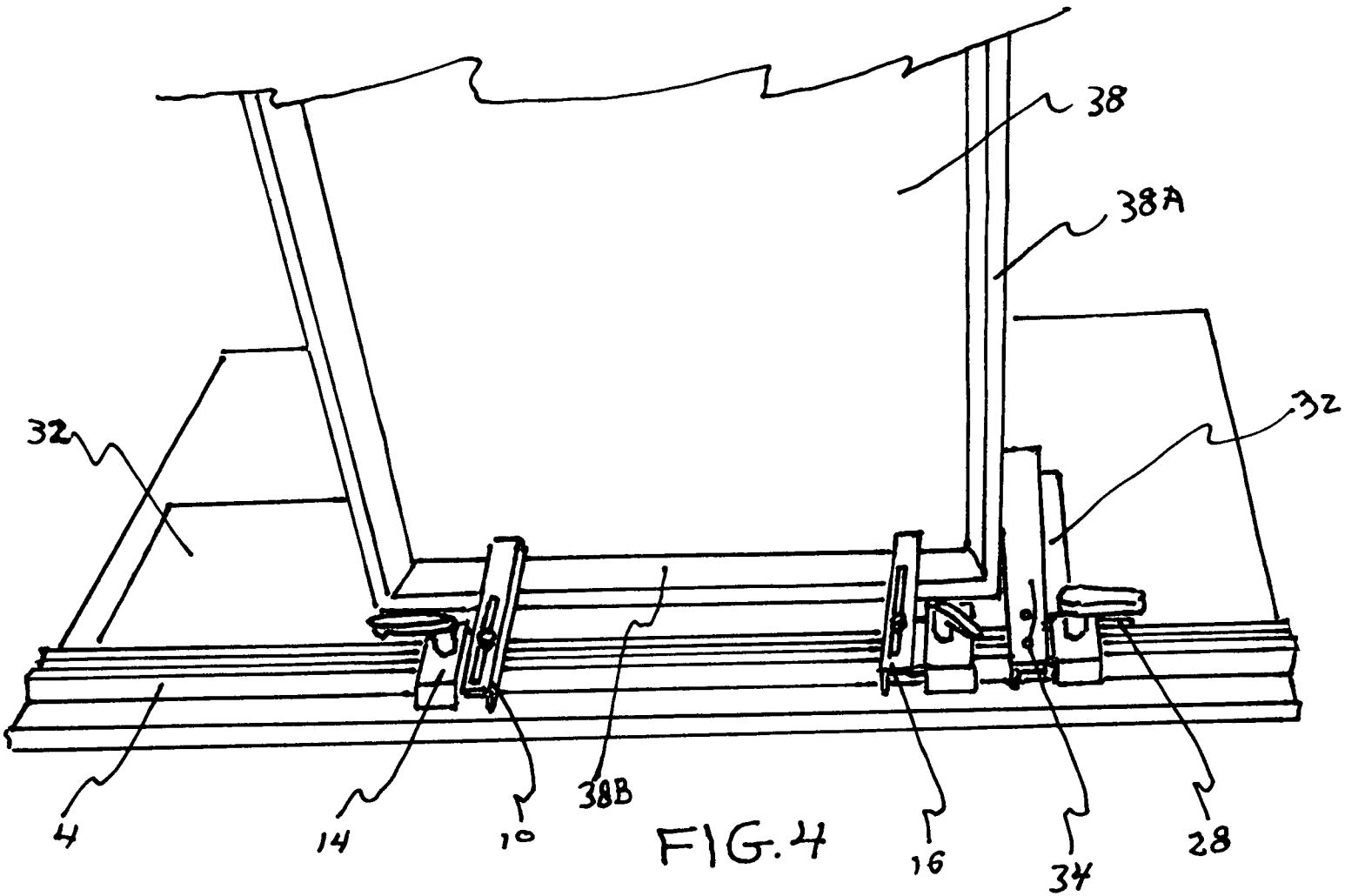
FIG. 4 is a perspective view of the invention in use.

FIG. 4 shows a perspective view of the invention in use. Drawer front 32 is being stopped by stop bar 28 and rail 4. The drawer box 38 is being stopped by drawer box stop bracket 34 along drawer box wall 38A and by first and second drawer box stop bars 10, 16. In this way, a carpenter can quickly and accurately locate a drawer front in proper relation to a drawer box in a repeated manner for as many drawers and necessary for a particular installation.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. drawer front jig comprising:

a base plate;

a rigid drawer front stop bar;

a rigid drawer box stop bracket;

a drawer box bracket retaining assembly;

a bracket assembly retaining rail member;

a rigid first drawer box stop bar;

a rigid second drawer box stop bar;

a first stop bar retaining assembly;

a second stop bar retaining assembly;

each said drawer box stop bar including an adjustment slot;

said rail fixedly attached near the front edge of the top of said base plate;

said drawer box stop bar held at right angles to said retaining rail by a standard bolt;

said rail having a longitudinally disposed T shaped slot along its top surface;

said rail having a longitudinally disposed T shaped slot along its inner side wall;

each said bar and bracket retaining assembly held onto said rail by a standard lock lever mechanism that interacts with said T slots;

each said bar and bracket retaining assembly comprised of a horizontal flat plate and a downwardly disposed fixedly attached plate formed at right angles to said flat plate;

said downwardly disposed plates sized to slidably engage the leading side wall of said rail member;

said drawer front stop bar held in place to the inner side wall of said rail member by a standard bolt; and said drawer front stop bracket and said drawer front stop bars positioned high enough to allow a standard drawer front to reside under them.

2. Drawer front jig as claimed in claim 1 wherein when a person places a drawer front on said base plate and places and locks said drawer front stop bar along side of said drawer front, and when said person positions said drawer box stop bracket against the side wall of a drawer box, and when said drawer box stop bars are slid to the desired position against the bottom of said vertically disposed drawer box, then said drawer fronts can be accurately and repeatedly positioned in the desired location with respect to said drawer boxes so that said drawer fronts and said drawer boxes can be joined together in a standard way.

* * * * *